US007677938B2

(12) United States Patent
Wiatrowski et al.

(10) Patent No.: US 7,677,938 B2
(45) Date of Patent: Mar. 16, 2010

(54) TILLER ARM

(75) Inventors: Darrell Wiatrowski, Beach Park, IL (US); Peter Lucier, Chicago, IL (US); Pierre Vignau, Sherbrooke, CA (US)

(73) Assignee: BRP US Inc., Sturtevant, WI (US)

( * ) Notice: Subject to any disclaimer, the term of this patent is extended or adjusted under 35 U.S.C. 154(b) by 0 days.

(21) Appl. No.: 12/263,059

(22) Filed: Oct. 31, 2008

(65) Prior Publication Data

US 2009/0075534 A1 Mar. 19, 2009

Related U.S. Application Data

(63) Continuation-in-part of application No. 11/848,770, filed on Aug. 31, 2007.

(51) Int. Cl.
*B63H 5/125* (2006.01)

(52) U.S. Cl. ..... 440/63; 440/53

(58) Field of Classification Search ..... 440/53, 440/63; 74/480 B, 525, 530
See application file for complete search history.

(56) References Cited

U.S. PATENT DOCUMENTS 5,340,342 A * 8/1994 Boda et al. ..... 440/86
5,632,657 A * 5/1997 Henderson ..... 440/6

* cited by examiner

*Primary Examiner*—Ed Swinehart
(74) *Attorney, Agent, or Firm*—Osler, Hoskin & Harcourt LLP

(57) ABSTRACT

A tiller arm pivotably mountable to a marine outboard engine about a pivot axis is described. First and second arms extend away from the pivot axis. A middle portion has a first end attached to the first and second arms. A handle portion extends away from the second end of the middle portion in a direction away from the pivot axis. A throttle grip is rotatably mounted to the handle portion and rotatable with respect thereto about a throttle grip axis generally perpendicular to the pivot axis. The throttle grip is operatively connectable to the marine outboard engine. The width of an aperture defined by the arms and the middle section is greater than the widths of the throttle grip and the first and second arms.

22 Claims, 6 Drawing Sheets

TILLER ARM

CROSS-REFERENCE

The present application is a continuation-in-part of pending U.S. patent application Ser. No. 11/848,770 filed on Aug. 31, 2007, the entirety of which is incorporated herein by reference.

FIELD OF THE INVENTION

The present invention relates to tiller arms for marine outboard engines.

BACKGROUND OF THE INVENTION

Many boats and other watercraft are propelled by one or more outboard engines disposed at the rear of the watercraft, which drive one or more propellers. Many different sizes of outboard engines are available, ranging from below 1 horsepower to over 350 horsepower, depending on the size of the watercraft to be powered and the power requirements of the user. During operation, a number of aspects of the operation of the outboard engine may be controlled by the user, depending on the particular outboard engine, such as starting and stopping the engine; throttle; tilt; trim; steering; shifting between forward, neutral and reverse modes; and the pitch of the propeller.

Larger outboard engines (e.g. above 30 horsepower) are typically used with larger and more sophisticated watercraft, which have electrical connections and controls for the outboard engine provided on the watercraft, often at a location remote from the outboard engine, such as a steering wheel or handlebar disposed at the front of the watercraft. Small and medium sized outboard engines (e.g. below 30 horsepower) are often used on watercraft without separate controls, and are typically controlled by a user positioned close to the outboard engine while the outboard engine is in operation. The user steers the watercraft by using a tiller arm to pivot the engine with respect to the watercraft about a vertical steering axis, and controls other aspects of the operation of the engine via controls mounted either on the tiller arm or on the outboard engine itself.

Referring to FIG. 1, a conventional tiller arm 10 includes an elongate tiller arm body 12 with a U-shaped cross-section, made of cast aluminum. Mechanical or electrical connections 14 are disposed inside the U-shaped cross-section to connect the throttle grip 16 and other controls 18 to the engine, either via an electronic control unit (ECU) (not shown) or via a mechanical linkage. A bottom cover (not shown), usually made of plastic, is optionally provided to conceal the mechanical or electrical connections 14 for aesthetic purposes. The user can move the tiller arm 10 to physically orient the engine as desired, for example to steer the watercraft. The user may also use the controls 16, 18 disposed on the tiller arm 10 to control the operation of the outboard engine. The number and type of controls disposed on the tiller arm 10 depend on the size and sophistication of the outboard engine. The tiller arm 10 can be pivoted relative to a raised position to provide additional space inside the watercraft when the engine is not in use. The tiller arm 10 can also be raised to provide a compact arrangement for transporting the outboard engine when it is detached from the watercraft, for example for maintenance or relocating from one body of water to another.

While conventional tiller arms are generally adequate for operating outboard engines, they have a number of drawbacks. In order to allow steering of the outboard engine, the tiller arm must withstand the forces required to physically rotate the outboard engine about the steering axis while the outboard engine is in operation. The force required is greater for a larger and more powerful outboard engine, necessitating a larger, stronger and heavier tiller arm. As a result, bulk and weight are added to an already large engine, resulting in diminished performance of the watercraft to which the outboard engine is mounted, and making transportation of the outboard engine cumbersome. A larger tiller arm may also be difficult for a user to grip with his hands, adding to the difficulty in transporting the outboard engine.

In addition, large tiller arms are costly to manufacture, due to their increased size and the increased quantity of aluminum and other materials required. Adding or removing even minor features of a cast aluminum tiller arm, for example to make ergonomic modifications or add or remove controls, may require replacing the mold used in the casting process, which represents a significant additional expense and discourages improvements to existing designs.

In addition, some users consider a large and bulky tiller arm to be aesthetically displeasing. However, such large and bulky tiller arms may be required to physically steer an engine that is large enough to satisfy the user's power requirements but still small enough to be used on a watercraft without separate steering and engine controls.

Plastic and composite tiller arms address some of the above concerns. However, due to the lower structural rigidity of plastic compared to aluminum, plastic tiller arms are currently used only on the smallest of outboard engines, typically those below 10 horsepower.

Therefore, there is a need for a tiller arm having reduced manufacturing cost.

There is also a need for a tiller arm having increased structural rigidity and reduced weight.

There is also a need for a tiller arm allowing for inexpensive design modifications.

There is also a need for a tiller arm allowing for easier transportation of an outboard engine to which it is attached.

SUMMARY OF THE INVENTION

It is an object of the present invention to ameliorate at least some of the inconveniences present in the prior art.

It is also an object of the present invention to provide a tiller arm with first and second arms defining a space therebetween, and gripping surfaces on the first and second arms.

In one aspect, the invention provides a tiller arm pivotably mountable to a marine outboard engine about a generally horizontally extending pivot axis when a driveshaft of the marine outboard engine is oriented generally vertically. The tiller arm comprises first and second arms extending away from the pivot axis. The first and second arms have respective first and second lengths in a direction extending away from the pivot axis. The first and second arms have respective first and second widths in a direction parallel to the pivot axis. A maximum distance between the first and second arms in the direction parallel to the pivot axis is greater than at least one of the first width and the second width. At least one of the first and second lengths is greater than the maximum distance. A middle portion has a first end attached to the first and second arms. A second end is opposite the first end. A handle portion extends away from the second end of the middle portion in a direction away from the pivot axis. The handle portion has a third width. The third width is less than the maximum distance. A throttle grip is rotatably mounted to the handle portion and rotatable with respect thereto about a throttle grip axis generally perpendicular to the pivot axis. The throttle grip is operatively connectable to the marine outboard engine. At least a portion of a transverse cross-section of at least one of the first and second arms in a plane perpendicular to the throttle grip axis generally has a U-shape. The U-shape defines at least in part a longitudinal cavity formed in the at least one of the first and second arms.

In a further aspect, the first arm is generally parallel to the second arm.

In a further aspect, the first width is approximately equal to the second width.

In a further aspect, the first and second arms and the middle portion together form a tiller arm body. The tiller arm body comprises a top portion and a bottom portion. The top portion is joined to the bottom portion via at least one fastener to form the longitudinal cavity therebetween.

In a further aspect, a transverse cross-section of at least one of the top and bottom portions taken through at least one of the first and second arms in a plane perpendicular to the throttle grip axis is generally U-shaped.

In a further aspect, the at least one of the first and second arms has at least one reinforcing rib disposed in the longitudinal cavity.

In a further aspect, the at least one reinforcing rib includes at least one first reinforcing rib disposed on the top portion and at least one second reinforcing rib disposed on the bottom portion.

In a further aspect, the throttle grip is operatively connectable to the marine outboard engine via an electrical connection disposed at least in part in the longitudinal cavity.

In a further aspect, the throttle grip is operatively connectable to the marine outboard engine via a mechanical connection disposed at least in part in the longitudinal cavity.

In a further aspect, a plurality of controls is disposed on the middle portion. The plurality of controls is electrically connectable to the marine outboard engine via an electrical connection disposed at least in part in the longitudinal cavity.

In a further aspect, a no-slip surface is disposed on at least a portion of at least one of the first and second arms.

In an additional aspect, the invention provides a tiller arm pivotably mountable to a marine outboard engine about a generally horizontally extending pivot axis when a driveshaft of the marine outboard engine is oriented generally vertically. The tiller arm comprises first and second arms extending away from the pivot axis. The first and second arms have respective first and second lengths in a direction extending away from the pivot axis. The first and second arms have respective first and second widths in a direction parallel to the pivot axis. A middle portion has a first end attached to the first and second arms. A second end is opposite the first end. A handle portion extends away from the second end of the middle portion in a direction away from the pivot axis. The handle portion has a third width. A throttle grip is rotatably mounted to the handle portion and rotatable with respect thereto about a throttle grip axis generally perpendicular to the pivot axis, the throttle grip being operatively connectable to the marine outboard engine. An aperture is defined between the first and second arms, the middle section and the pivot axis. The aperture has a third length in a direction generally parallel to the throttle grip axis. The aperture has a fourth width in a direction generally parallel to the pivot axis. The third length is greater than the fourth width. The fourth width is greater than each of the first, second and third widths.

In a further aspect, the first arm is generally parallel to the second arm.

In a further aspect, the first width is approximately equal to the second width.

In a further aspect, a longitudinal cavity is formed in the middle portion and in at least one of the first and second arms.

In a further aspect, the first and second arms and the middle portion together form a tiller arm body. The tiller arm body comprises a top portion and a bottom portion. The top portion is joined to the bottom portion via at least one fastener to form the longitudinal cavity therebetween.

In a further aspect, a transverse cross-section of at least one of the top and bottom portions taken through at least one of the first and second arms in a plane perpendicular to the throttle grip axis is generally U-shaped.

In a further aspect, the at least one of the first and second arms has at least one reinforcing rib disposed in the longitudinal cavity.

In a further aspect, the at least one reinforcing rib includes at least one first reinforcing rib disposed on the top portion and at least one second reinforcing rib disposed on the bottom portion.

In a further aspect, the throttle grip is operatively connectable to the marine outboard engine via an electrical connection disposed at least in part in the longitudinal cavity.

In a further aspect, the throttle grip is operatively connectable to the marine outboard engine via a mechanical connection disposed at least in part in the longitudinal cavity.

In a further aspect, a no-slip surface is disposed on at least a portion of at least one of the first and second arms.

In the present application, terms related to spatial orientation such as forwardly, rearwardly, left, and right, should be interpreted as they would normally be understood by a driver of a watercraft sitting thereon in a normal driving position, when the outboard engine is mounted on the stern of the watercraft with the driveshaft oriented vertically and the tiller arm oriented horizontally. When these terms are used in relation to a tiller arm, they should be interpreted as they would normally be understood if the tiller arm were installed on an outboard engine and oriented horizontally, with the outboard engine steered straight (i.e. with the propeller shaft parallel to the longitudinal axis of the watercraft).

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
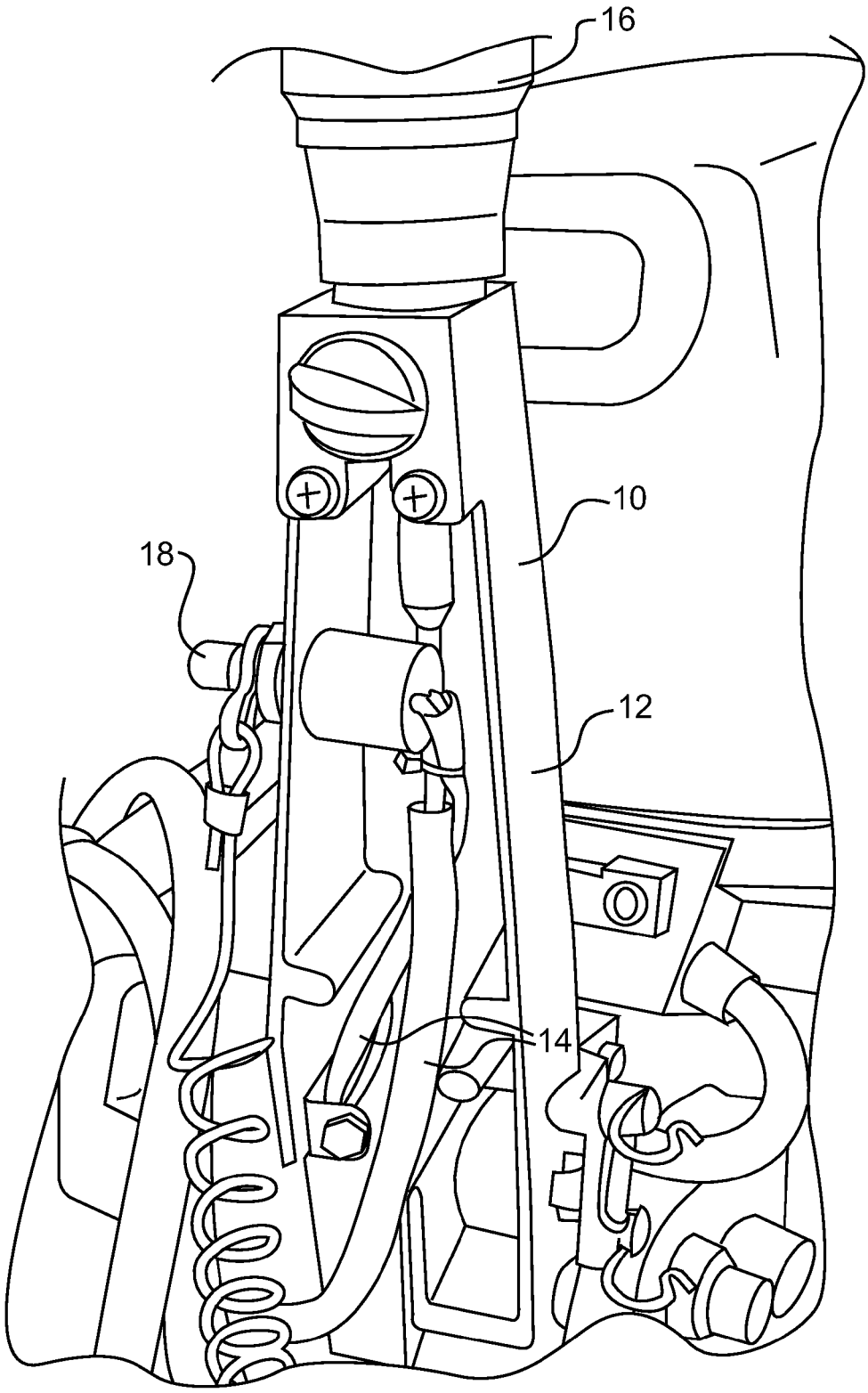
FIG. 1 PRIOR ART
FIG. 1 is a perspective view, taken from a front, left side, of a marine outboard engine with a tiller arm according to the prior art.
Figure 2:
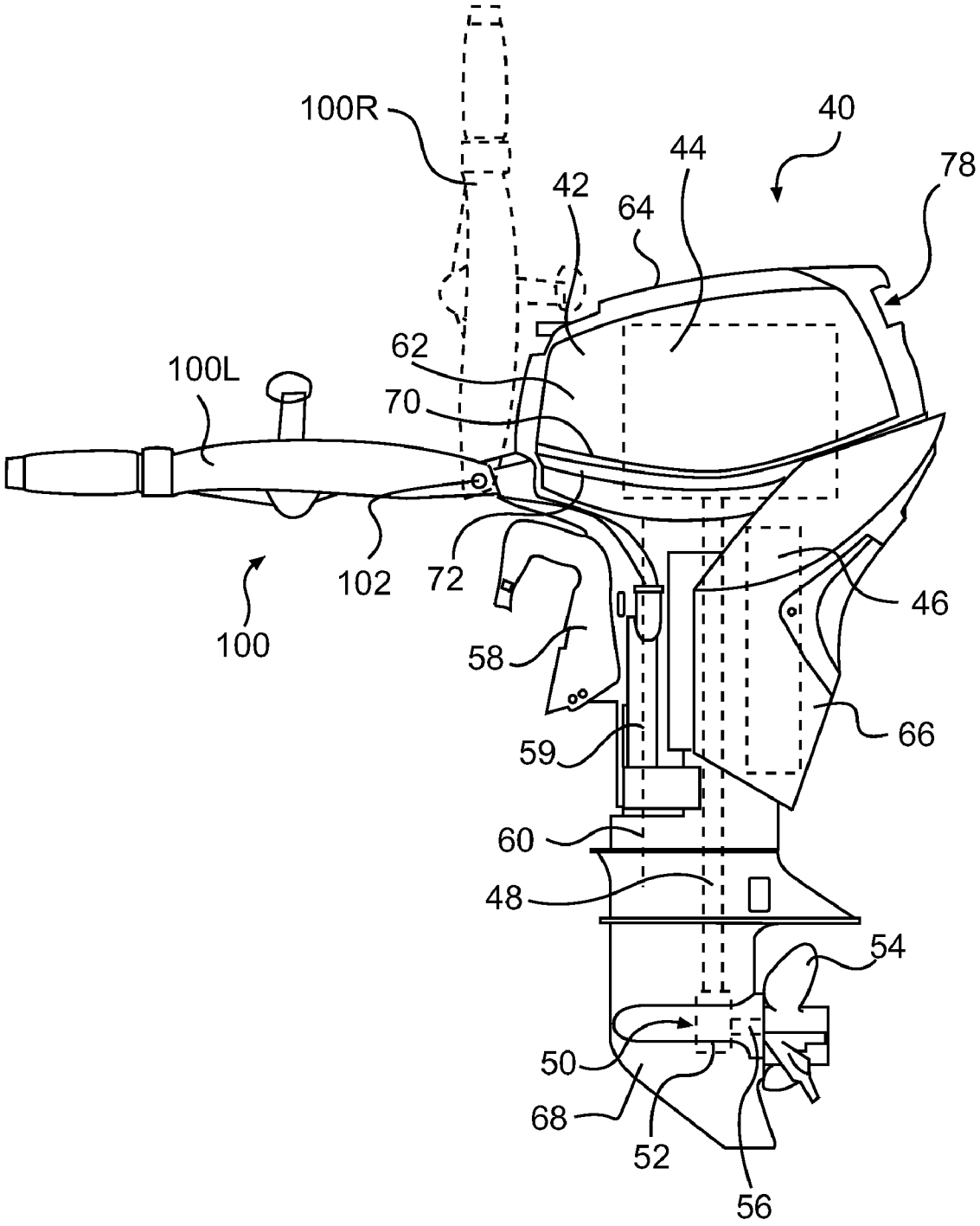
FIG. 2 is a left side elevation view of a marine outboard engine with a tiller arm according to the present invention.

Referring to FIG. 2, an outboard engine 40 will be described having a tiller arm 100 according to an embodiment of the invention.

FIG. 2 is a side view of a marine outboard engine 40 having a cowling 42. The cowling 42 surrounds and protects an engine 44, shown schematically. The engine 44 may be any suitable engine known in the art, such as an internal combustion engine. An exhaust system 46, shown schematically, is connected to the engine 44 and is also surrounded by the cowling 42.

The engine 44 is coupled to a vertically oriented driveshaft 48. The driveshaft 48 is coupled to a drive mechanism 50, which includes a transmission 52 and a bladed rotor, such as a propeller assembly 54 mounted on a propeller shaft 56. The propeller shaft 56 is generally perpendicular to the driveshaft 48. Other known components of an engine assembly are included within the cowling 42, such as a starter motor and an alternator. As it is believed that these components would be readily recognized by one of ordinary skill in the art, further explanation and description of these components will not be provided herein.

A stern bracket 58 is connected to the cowling 42 via the swivel bracket 59 for mounting the outboard engine 40 to a watercraft. The stern bracket 58 and swivel bracket 59 can take various forms, the details of which are conventionally known. The swivel bracket 59 permits the outboard engine 40 to be pivoted about the vertical steering axis 60 to steer the watercraft, as will be discussed below in further detail.

The cowling 42 includes several primary components, including an upper motor cover 62 with a top cap 64, and a lower motor cover 66. A lowermost portion, commonly called the gear case 68, is attached to the exhaust system 46. The upper motor cover 62 preferably encloses the top portion of the engine 44. The lower motor cover 66 surrounds the remainder of the engine 44 and the exhaust system 46. The gear case 68 encloses the transmission 52 and supports the drive mechanism 50.

The upper motor cover 62 and the lower motor cover 66 are made of sheet material, preferably plastic, but could also be metal, composite or the like. The lower motor cover 66 and/or other components of the cowling 42 can be formed as a single piece or as several pieces. For example, the lower motor cover 66 can be formed as two lateral pieces that mate along a vertical joint. The lower motor cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower motor cover 66. A seal (not shown) is disposed between the lower edge 70 of the upper motor cover 62 and the upper edge 72 of the lower motor cover 66 to form a watertight connection.

The upper motor cover 62 is formed with two parts, but could also be a single cover. As seen in FIG. 2, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78. Alternatively, the air intake portion 78 can be wholly formed in the upper motor cover 62 or even the lower motor cover 66.

A tiller arm 100 is pivotably connected to the cowling 42 of the outboard engine 40, such that the tiller arm 100 can pivot with respect to the outboard engine 40 about the horizontal pivot axis 102 from a lowered position 100L, in which the tiller arm 100 can be used to steer the outboard engine 40 while in use, to a raised position 100R, which allows additional space inside the watercraft if the outboard engine 40 is mounted on the watercraft, and convenient storage and transportation of the outboard engine 40 if the outboard engine 40 is removed from the watercraft. It is contemplated that the tiller arm 100 may additionally be pivotable to one or more intermediate positions between the lowered position 100L and the raised position 100R.

Referring generally to FIGS. 3-6, the tiller arm 100 will be described in further detail.

Figure 3:
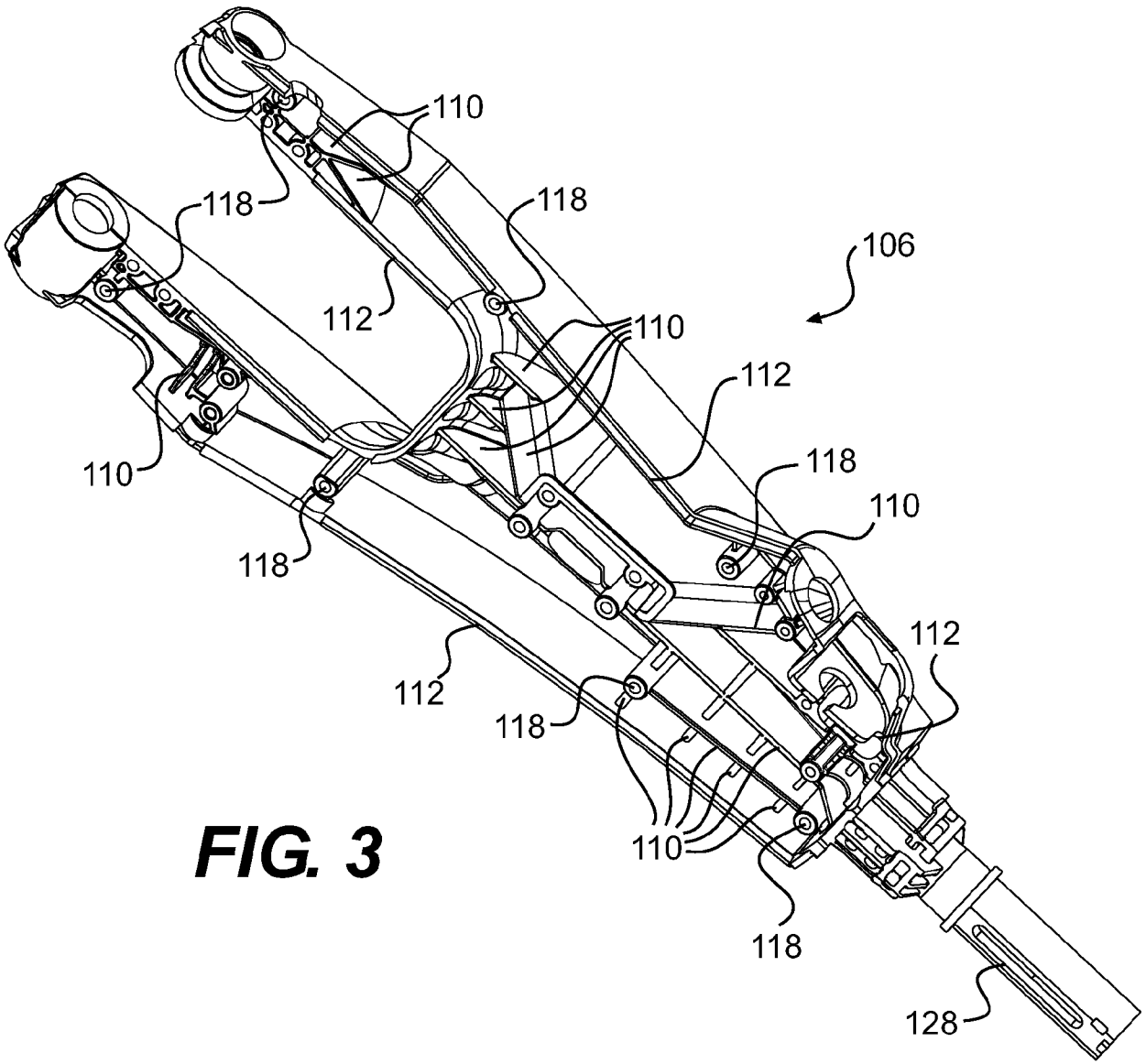
FIG. 3 is a bottom perspective view, taken from a front, right side, of the top portion of the tiller arm of FIG. 2.
Figure 4:
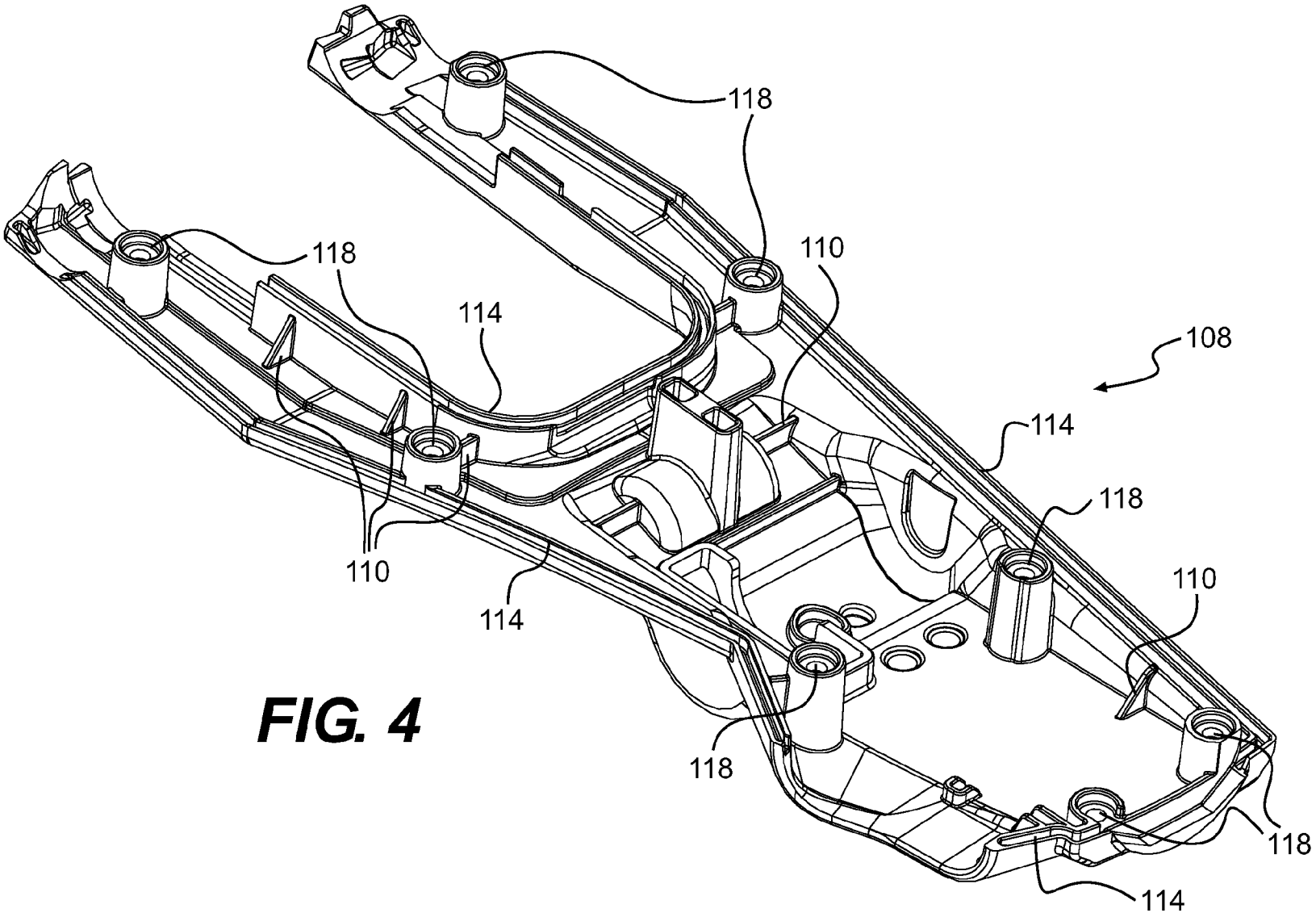
FIG. 4 is a top perspective view, taken from a front, right side, of the bottom portion of the tiller arm of FIG. 2.

The tiller arm 100 has a tiller arm body 104 (FIG. 5) formed by joining a top portion 106 (FIG. 3) and a bottom portion 108 (FIG. 4). The top portion 106 and the bottom portion 108 are preferably made of a polymer or composite material to provide light weight construction. It should be understood that a polymer or composite construction can be modified, for example to add or remove features, more easily and inexpensively than a similar cast aluminum construction. A number of reinforcing ribs 110 enhance the structural rigidity of the tiller arm body 104. At least a portion of the edge 112 of the top portion 106 is configured to mate with a corresponding portion of the edge 114 of the bottom portion 108 via a tongue and groove connection to further enhance the structural rigidity of the tiller arm body 104 by distributing stresses between the top portion 106 and the bottom portion 108. The top portion 106 is joined to the bottom portion 108 by a plurality of fasteners in the form of screws 116 (FIG. 6) received in the bosses 118. It is contemplated that any other suitable fasteners may alternatively be used, such as protrusions on one of the top portion 106 and the bottom portion 108 that snap into corresponding recesses in the other of the top portion 106 and the bottom portion 108 to form a tight fit. It is also contemplated that adhesives may be used to join the top portion 106 to the bottom portion 108.

Figure 5:
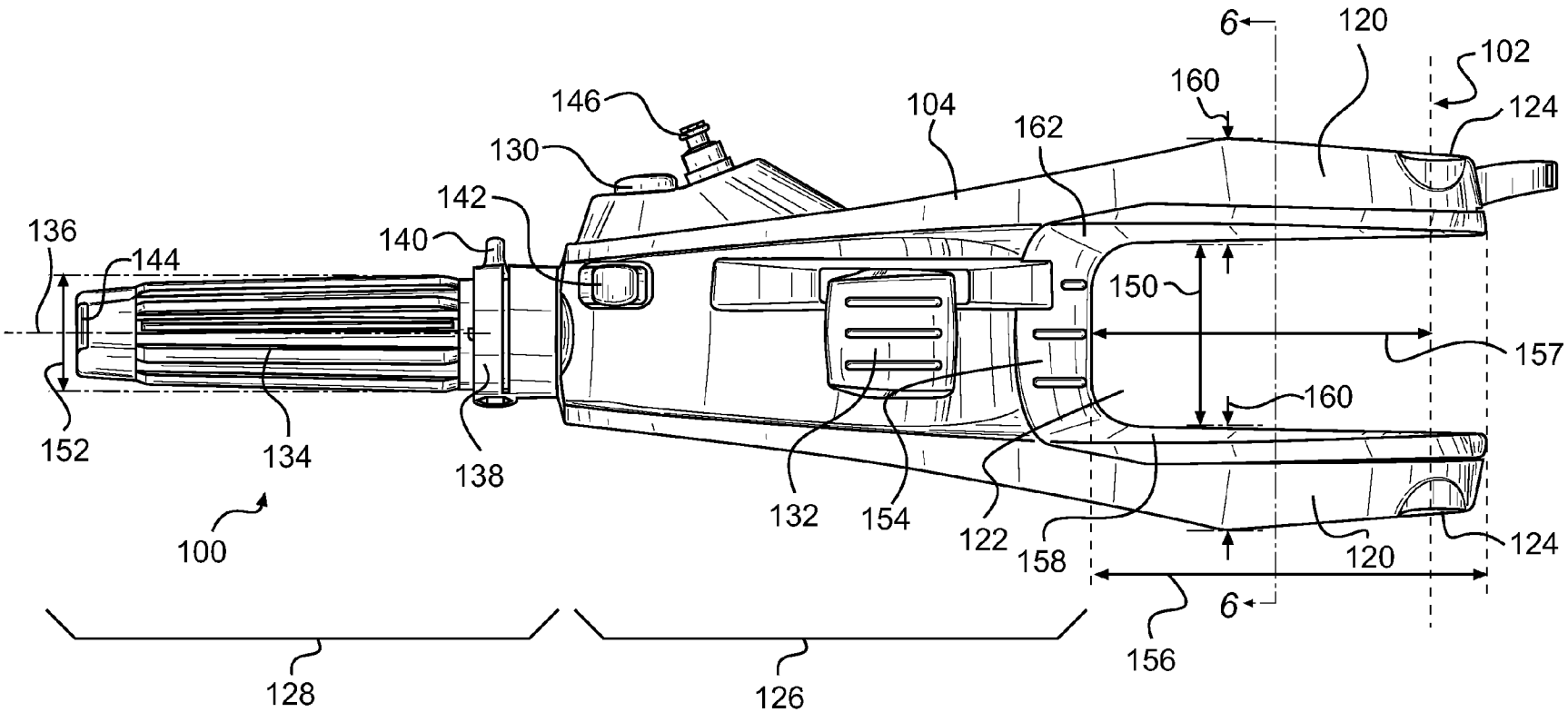
FIG. 5 is a top plan view of the tiller arm of FIG. 2.

Referring to FIG. 5, two arms 120 extend away from the pivot axis 102. The arms 120 are generally parallel and spaced apart from each other to form an aperture 122 therebetween. Bosses 124 co-axial with the pivot axis 102 are disposed at a first end of each of the arms 120 for attachment to the outboard engine 40. The second end of each of the arms 120 is attached to a first end of a middle portion 126 of the tiller arm body 104. A handle portion 128 is attached to a second end of the middle portion 126. The handle portion 128 is formed integrally with either top portion 106, as seen in FIG. 3. It is contemplated that the handle portion 128 may alternatively be formed integrally with the bottom portion 108, or as a separate component that is later attached to the tiller arm body 104.

Figure 6:
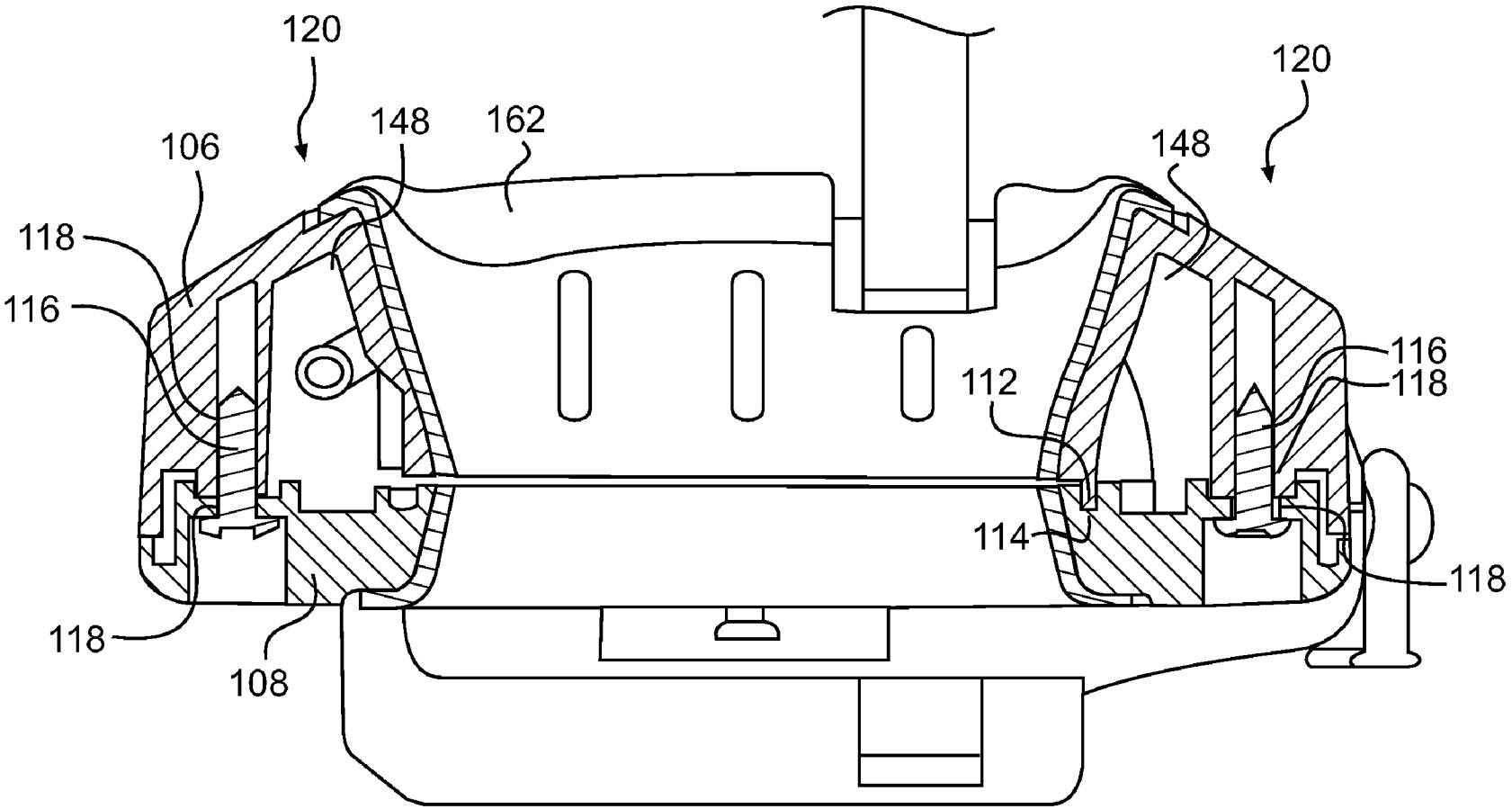
FIG. 6 is a cross-sectional view of the tiller arm of FIG. 2, taken along the line 6-6 in FIG. 5.

Referring to FIG. 6, a cross section of the arms 120 is shown, taken in a plane generally perpendicular to the throttle grip axis 136. The top portion 106 has a generally U-shaped cross-section in each arm 120, such that each arm 120 has a longitudinal cavity 148 disposed therein. It is contemplated that the bottom portion 108 may alternatively or additionally have a U-shaped cross-section to form the longitudinal cavity 148. The longitudinal cavity 148 of at least one arm 120 communicates with a similar cavity (not shown) in the middle portion 126 to form a single longitudinal cavity. It is contemplated that only one arm 120 may alternatively have a longitudinal cavity 148 formed therein. The longitudinal cavities 148 contribute to a lightweight construction, and allow mechanical or electrical connections passing therethrough to operatively connect the outboard engine 40 to the controls disposed on the tiller arm body 104. The controls will be described below in further detail.

Referring back to FIG. 5, when the outboard engine 40 is in use, the user may use the tiller arm 100 to control various aspects of the operation of the outboard engine 40 via controls located on the tiller arm body 104 or the handle portion 128. The user starts the engine 44 with the start button 130 disposed on the middle portion 126. A shift lever 132 disposed on the middle portion 126 allows the user to select a forward, neutral or reverse gear. A throttle grip 134 serves as a handle for allowing the user to steer the outboard engine 40 by pivoting the throttle grip 134 about the steering axis 60 (FIG. 2). The throttle grip 134 is also rotatable with respect to the handle portion 128 about a throttle grip axis 136 generally perpendicular to the pivot axis 102 to open or close the throttle of the engine 44. The diameter 152 of the throttle grip 134 is preferably about 1.6 inches, so that it can be conveniently gripped by a user's hand, though it is contemplated that the dimensions may vary with the size of the outboard engine 40. A throttle friction ring 138 can be adjusted by tightening or loosening an adjustment screw 140 to adjust the force required to rotate the throttle grip 134, or to lock the throttle grip 134 in a desired position. An idle speed adjuster 142 is provided near the throttle grip 134 to control the RPM of the engine 44 when the throttle grip 134 is in the idle position corresponding to a minimum throttle opening position. A tilt/trim control 144 at the end of the handle portion allows the user to control the tilt and trim of the outboard engine 40. A stop button 146 is provided next to the start button 130 to stop the engine 44. The stop button 146 may be equipped with a safety lanyard (not shown). It is contemplated that additional controls may be added, corresponding to additional features of the outboard engine 40 that the user may desire to control. It is further contemplated that one or more of the controls may be altered, re-positioned or omitted. For example, the start button 130 could be omitted on an outboard engine equipped with a rope starter. In addition, some controls, such as the shift lever 132 or the tilt/trim control 144, may be provided directly on the cowling 42 instead of on the tiller arm body 104.

When the outboard engine 40 is not in use, the tiller arm 100 can be pivoted to the raised position 100R to make the outboard engine 40 more compact. Referring to FIGS. 5 and 6, the tiller arm 100 is dimensioned such that various parts of the tiller arm body 104 can be conveniently gripped to support the outboard engine 40 during transportation. The maximum width 150 of the aperture 122 in a direction generally parallel to the pivot axis 102 is greater than the width 152 of the throttle grip 134, to provide a sufficiently wide gripping surface 154 on the first end of the middle portion 126. The width 150 also contributes to the structural rigidity of the tiller arm body 140, by distributing stresses between the two arms 120 while steering the outboard engine 40. The width 150 is preferably about 3.1 inches, though it is contemplated that the dimensions may vary with the size of the outboard engine 40. The length 156 of the arms 120 in a direction generally parallel to the throttle grip axis 134 is greater than the width 150, such that the length 157 of the aperture 122 between the middle portion 126 and the pivot axis 102 provides a sufficiently wide gripping surface 158 on each arm 120 to comfortably accommodate a person's hand at a comfortable distance from the pivot axis 102. The length 156 of the arms 120 also contributes to added leverage when the tiller arm 100 is used to steer the watercraft. The lengths 156 and 157 are preferably at least about 6 inches, though it is contemplated that the dimensions may vary with the size of the outboard engine 40. The width 160 of each arm 120 is large enough to provide structural rigidity to the tiller arm body 104, while being small enough to be conveniently gripped by a person's hand. The width 160 is preferably about 1.6 inches, comparable to the width 152 of the throttle grip 134, though it is contemplated that the dimensions may vary with the size of the outboard engine 40. A no-slip surface 162 is provided on at least a portion of the arms 120 and the gripping surface 154. The no-slip surface may be either a textured surface of the tiller arm body 104 or a no-slip material such as rubber adhered to the tiller arm body 104 in any suitable manner such as with an adhesive or by overmolding. It is contemplated that the two arms 120 may have different dimensions, provided that at least one of the arms 120 has the dimensions described above so as to provide a convenient gripping surface.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A tiller arm pivotably mountable to a marine outboard engine about a generally horizontally extending pivot axis when a driveshaft of the marine outboard engine is oriented generally vertically, the tiller arm comprising:

first and second arms extending away from the pivot axis, the first and second arms having respective first and second lengths in a direction extending away from the pivot axis, the first and second arms having respective first and second widths in a direction parallel to the pivot axis, a maximum distance between the first and second arms in the direction parallel to the pivot axis being greater than at least one of the first width and the second width, at least one of the first and second lengths being greater than the maximum distance;

a middle portion having:

a first end attached to the first and second arms; and a second end opposite the first end; and a handle portion extending away from the second end of the middle portion in a direction away from the pivot axis, the handle portion having a third width, the third width being less than the maximum distance; and a throttle grip rotatably mounted to the handle portion and rotatable with respect thereto about a throttle grip axis generally perpendicular to the pivot axis, the throttle grip being operatively connectable to the marine outboard engine;

at least a portion of a transverse cross-section of at least one of the first and second arms in a plane perpendicular to the throttle grip axis generally having a U-shape, the U-shape defining at least in part a longitudinal cavity formed in the at least one of the first and second arms.

2. The tiller arm of claim 1, wherein the first arm is generally parallel to the second arm.

3. The tiller arm of claim 2, wherein the first width is approximately equal to the second width.

4. The tiller arm of claim 1, wherein the first and second arms and the middle portion together form a tiller arm body, the tiller arm body comprising a top portion and a bottom portion, the top portion being joined to the bottom portion via at least one fastener to form the longitudinal cavity therebetween.

5. The tiller arm of claim 4, wherein a transverse cross-section of at least one of the top and bottom portions taken through at least one of the first and second arms in a plane perpendicular to the throttle grip axis is generally U-shaped.

6. The tiller arm of claim 5, wherein the at least one of the first and second arms has at least one reinforcing rib disposed in the longitudinal cavity.

7. The tiller arm of claim 6, wherein the at least one reinforcing rib includes at least one first reinforcing rib disposed on the top portion and at least one second reinforcing rib disposed on the bottom portion.

8. The tiller arm of claim 1, wherein the throttle grip is operatively connectable to the marine outboard engine via an electrical connection disposed at least in part in the longitudinal cavity.

9. The tiller arm of claim 1, wherein the throttle grip is operatively connectable to the marine outboard engine via a mechanical connection disposed at least in part in the longitudinal cavity.

10. The tiller arm of claim 1, further comprising a plurality of controls disposed on the middle portion, the plurality of controls being electrically connectable to the marine outboard engine via an electrical connection disposed at least in part in the longitudinal cavity.

11. The tiller arm of claim 1, further comprising a no-slip surface disposed on at least a portion of at least one of the first and second arms.

12. A tiller arm pivotably mountable to a marine outboard engine about a generally horizontally extending pivot axis when a driveshaft of the marine outboard engine is oriented generally vertically, the tiller arm comprising:

first and second arms extending away from the pivot axis, the first and second arms having respective first and second lengths in a direction extending away from the pivot axis, the first and second arms having respective first and second widths in a direction parallel to the pivot axis;

a middle portion having:

a first end attached to the first and second arms; and a second end opposite the first end; and a handle portion extending away from the second end of the middle portion in a direction away from the pivot axis, the handle portion having a third width;

a throttle grip rotatably mounted to the handle portion and rotatable with respect thereto about a throttle grip axis generally perpendicular to the pivot axis, the throttle grip being operatively connectable to the marine outboard engine; and an aperture defined between the first and second arms, the middle section and the pivot axis, the aperture having a third length in a direction generally parallel to the throttle grip axis, the aperture having a fourth width in a direction generally parallel to the pivot axis, the third length being greater than the fourth width, the fourth width being greater than each of the first, second and third widths.

13. The tiller arm of claim 12, wherein the first arm is generally parallel to the second arm.

14. The tiller arm of claim 13, wherein the first width is approximately equal to the second width.

15. The tiller arm of claim 12, further comprising a longitudinal cavity formed in the middle portion and in at least one of the first and second arms.

16. The tiller arm of claim 15, wherein the first and second arms and the middle portion together form a tiller arm body, the tiller arm body comprising a top portion and a bottom portion, the top portion being joined to the bottom portion via at least one fastener to form the longitudinal cavity therebetween.

17. The tiller arm of claim 16, wherein a transverse cross-section of at least one of the top and bottom portions taken through at least one of the first and second arms in a plane perpendicular to the throttle grip axis is generally U-shaped.

18. The tiller arm of claim 17, wherein the at least one of the first and second arms has at least one reinforcing rib disposed in the longitudinal cavity.

19. The tiller arm of claim 18, wherein the at least one reinforcing rib includes at least one first reinforcing rib disposed on the top portion and at least one second reinforcing rib disposed on the bottom portion.

20. The tiller arm of claim 15, wherein the throttle grip is operatively connectable to the marine outboard engine via an electrical connection disposed at least in part in the longitudinal cavity.

21. The tiller arm of claim 15, wherein the throttle grip is operatively connectable to the marine outboard engine via a mechanical connection disposed at least in part in the longitudinal cavity.

22. The tiller arm of claim 12, further comprising a no-slip surface disposed on at least a portion of at least one of the first and second arms.

* * * * *